US006759929B2

(12) United States Patent
Henningsson et al.

(10) Patent No.: US 6,759,929 B2
(45) Date of Patent: Jul. 6, 2004

(54) COUPLING LOOP HOUSED IN A DIELECTRIC PART

(75) Inventors: Uno Henningsson, Haninge (SE); Christer Ahlberg, Kolbäck (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 60 days.

(21) Appl. No.: 09/981,789

(22) Filed: Oct. 19, 2001

(65) Prior Publication Data

US 2002/0084866 A1 Jul. 4, 2002

(30) Foreign Application Priority Data

Oct. 20, 2000 (SE) ..... 0003801

(51) Int. Cl.[7] ..... H01P 5/02; H01P 5/08
(52) U.S. Cl. ..... 333/230; 333/24 R
(58) Field of Search ..... 333/230, 24 R

(56) References Cited

U.S. PATENT DOCUMENTS 4,801,903 A 1/1989 Mohr
5,847,627 A * 12/1998 Radzikowski et al. .. 333/230 X
6,005,452 A 12/1999 Ahlberg

FOREIGN PATENT DOCUMENTS

GB 2134721 A 8/1984
JP 4177902 A * 6/1992 ..... 333/230

* cited by examiner

*Primary Examiner*—Benny Lee

(57) ABSTRACT

The present invention relates to a device (1) for transmitting or receiving electromagnetic waves in a cavity (3), where the device comprises a loop (10) and a dielectric part (9) that houses at least a first end part (11) of the loop. The dielectric part comprises a first recess (37) designed to receive a means (30) for setting the capacitance between the loop and an earthed cavity housing (5), cover (6) or casing (2) for electric and/or electronic components. The invention also relates to a method for manufacturing the device, a method for manufacturing the loop, a cavity filter (4) and the casing.

13 Claims, 4 Drawing Sheets

COUPLING LOOP HOUSED IN A DIELECTRIC PART

TECHNICAL FIELD OF THE INVENTION

The present invention relates in general to a device for receiving or transmitting electromagnetic waves in a cavity, where the device comprises a loop and a dielectric part that houses at least a first end part of the loop. The invention also relates to a method for manufacturing the device, a method for manufacturing the loop, a cavity filter and a casing for electrical and/or electronic components.

DESCRIPTION OF RELATED TECHNOLOGY

In, for example, radio base stations for mobile telephony, cavity filters are normally used for a combiner between radio frequency transmitters and an antenna. Such a system is shown in U.S. Pat. No. 6,005,452 which is hereby incorporated as a reference.

U.S. Pat. No. 6,005,452 shows an insulator with integral input signal loop, This loop is inserted and attached in a cavity filter that is earthed arid the loop is insulated from the cavity filter by means of the insulator. The distance between an end, that is not in contact with the insulator, and a hollow screw, can be adjusted, which means that the capacitance between the loop and the cavity filter can be adjusted. This adjustment means that, for example, the bandwidth of the radio frequencies that pass through the filter can be increased or decreased, The end is connected to an electrically conductive spindle which in turn is surrounded by a dielectric casing. This dielectric casing is connected to the wall of the cavity filter, which helps to fix the position of the loop in relation to the cavity filter.

Even though the cavity filter and the input device in the document mentioned above have been found to work well, it could be desirable to reduce the number of parts required for fixing the loop and for adjusting the capacitance between the loop and the casing, in order to ensure in a simple way that the position of the loop is better fixed and that the assembly and disassembly of the loop in a cavity filter can be carried out more quickly.

SUMMARY OF THE INVENTION

A general aim of the present invention is to achieve a device that allows a more simple design and fixing of a loop in a cavity filter for electromagnetic waves, while at the same time making possible simple changing of the capacitance between the loop and a grounded casing. Additional aims, effects and advantages will be apparent from the following description. The general aim of the present invention is achieved by a device for transmitting or receiving electromagnetic waves for a cavity, where the device comprises a loop and a dielectric part that houses at least a first end part of the loop, where the dielectric part defines a first recess designed to receive a means for setting the capacitance between the loop and a casing connected to earth, cavity housing and/or cover. A device is hereby achieved that only consists of one dielectric item with an embedded loop, for the transmission of signals to or from a cavity, while at the same time a means can easily be used to set the capacitance between the loop and the casing.

The loop suitably comprises an essentially flat section that is designed for a predetermined frequency. This flat section is located in the first recess and has a flat first area that is designed to be turned towards the means for setting the capacitance. The flat section has also an essentially flat second area that is parallel to the first area and the first recess is continuous in order to be able to receive the means for setting the capacitance from two directions. A symmetric hole is hereby achieved that, together with the two areas, provides a greater degree of choice for the location of the device in, for example, a casing.

The first end part has an essentially straight longitudinal axis and the first recess is turned essentially at right angles to this longitudinal axis. The first recess is preferably turned essentially at right angles to the main plane of the loop. By this means, simple adjustments of the capacitance can be carried out when the device is inserted in the casing or assembled in such a way that a distance between the end part and a means for changing the capacitance, adjustable in the axial direction of the end part, is not able to be adjusted from outside, but where a radial distance between the end part and the means can be adjusted from outside.

In addition, the device comprises at least one rib that is inserted in the first recess to make contact with the means for setting the capacitance. This rib helps to fix the means in relation to the loop in such a way that it is adjustable. If the means is a screw that is screwed into a threaded hole in, for example, a casing for electrical and/or electronic components and inserted in the recess, the rib provides a continuation of the threads in the threaded hole, which guarantees a reliable fastening of the screw at the required distance from the loop.

The device can also comprise at least one stop pin projecting into the first recess in front of the flat first area or second area in the direction of insertion of the means towards the flat area, in order to prevent the means for setting the capacitance from coming into galvanic contact with the loop and to prevent electrical flash-over between the loop and the means for setting the capacitance.

The dielectric part preferably houses a second end part of the loop. In addition to a simplification of both the device itself and its assembly, this also achieves a more secure fixing of the loop in relation to the dielectric part and in relation to the cavity in which it is inserted, in comparison to the previous technology.

In addition, the second end part is essentially parallel to the first end part and at least one of them is milled in order to provide good fixing of the loop when it is embedded in the dielectric part, The dielectric part is designed to provide a particular impedance to the grounded casing or cavity housing, together with the loop. In this way, a method can be used for adjusting, for example, the bandwidth of frequencies that pass through a cavity filter, where, for example, the bandwidth is only changed by changing the capacitance between earth and the loop.

In order to reduce still further the assembly time and to make the actual assembly work easier, the dielectric part comprises a locking device. This locking device can be inserted into a corresponding recess or through-hole in, for example, a casing for electrical and/or electronic components and makes possible rapid locking between the device and the casing. In order to fix the device to the casing more securely, the dielectric part comprises a fixing hole designed to receive a fixing element for fixing the device to the casing.

The dielectric part suitably comprises at least a second recess that ensures that more dielectric in the form of air surrounds the loop. In this way, an optimization is achieved between mechanical stability requirements and position accuracy requirements for the loop and the creation of a higher impedance around the means for setting the capacitance.

Instead of stop pins, the dielectric part can comprise a bottom surface of the first recess, which bottom surface covers the flat section from a first direction, in order to prevent the means for setting the capacitance coming into galvanic contact with the loop and to prevent electrical flash-over between the loop and the means for setting the capacitance. In an alternative embodiment, the dielectric part can also comprise a recess essentially reversed in relation to the first recess, with a bottom surface that covers the flat section from an opposite direction to the first direction.

The present invention also relates to a method for manufacturing the device, comprising the steps of:

determining the length of the loop that is to be inserted at least partially into the cavity;

forming, for example by stamping, the essentially flat area that is designed for a particular frequency; and at least partially embedding the first end part of the loop in the dielectric part, which is, for example, of plastic and is so formed that together with the loop it provides a particular impedance to the earthed casing or the cavity housing.

The steps preferably also comprise milling at least one of the first and second end parts in order to provide a better fixing of the loop in the dielectric part and at least partially embedding the second end part of the loop.

In addition, the present invention relates to a method for manufacturing the loop for the device, which method comprises the steps of:

determining the length of the loop that is to be inserted at least partially into the cavity and forming, for example by stamping, the essentially flat area that is designed for a particular frequency. Also here the step preferably comprises milling at least one of the first and second end parts in order to provide a better fixing of the loop in the dielectric part.

The present invention also relates to a casing for electrical and/or electronic components that comprises the device and at least one opening for receiving the device. By this means, the device can be fixed in the casing and can be connected in a simple and secure way to other components housed in the casing, such as microfrequency directional couplers and circulators, for example for cavity filters for combiner filters, while a part of the device protrudes from the outer edge of the casing. This means that the protruding part can be inserted into the cavity through a hole in a cavity wall designed for the protruding part. The casing suitably comprises at least one flange that has a recess or through-hole to receive a locking device, a first threaded hole designed to receive the fixing element for fixing the device to the casing and a second threaded hole designed to receive the means for setting the capacitance between the loop and the casing. By this means, an even better fixing and alignment of the device is achieved when it is inserted into the casing.

In addition, the present invention comprises a cavity filter, such as a waveguide filter, a ceramic filter or a coaxial filter for electromagnetic waves. The cavity filter comprises the cavity and the device.

BRIEF DESCRIPTION OF THE DRAWINGS

The aims, advantages and effects, and the characteristics of the present invention will be understood more easily as a result of the following detailed description of embodiments, where the description is to be read in conjunction with the enclosed drawings, in which.

DETAILED DESCRIPTION OF EMBODIMENTS

Figure 1:
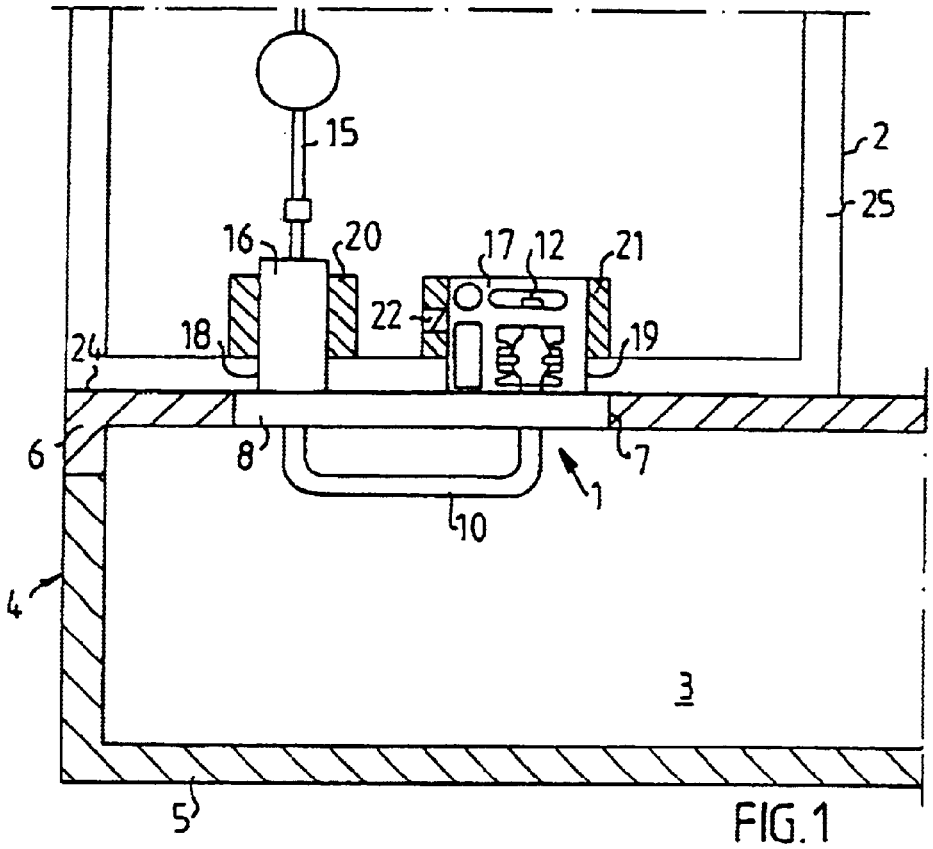
FIG. 1 shows, partly in cross-section, a schematic side view of a part of a cavity, in which is inserted a loop for supplying or tapping off electromagnetic waves.

While the invention covers various modifications and alternative designs, a preferred embodiment of the invention is shown in the drawings and will be described in detail below. It should, however, be understood that the special description and the drawings are not intended to limit the invention to the specific form shown. On the contrary, it is intended that the scope of the invention to which the application refers comprises all modifications and alternative designs thereof that fall within the concept and scope of the invention as expressed in the attached claims.

FIG. 1 shows schematically an embodiment of a device 1 according to the invention in relation to a casing 2 for housing electrical and/or electronic components and a cavity 3 for electromagnetic waves. In this example, the cavity 3 can be seen to be a part of a cavity filter 4, such as a so-called ceramic filter for microwaves, The cavity 3 is defined by a cavity housing 5 and a cover 6, and as it is a cavity filter, a resonance device (not shown), such as a ceramic resonator and tuner, can be inserted in the cavity 3. The cover 6 is provided with an elongated hole 7 that fits a first part 8 of a dielectric part 9, designed among other things to fit in the hole 7, (see FIG. 3). The dielectric part 9 is constructed of plastic, preferably polyesterimide, and constitutes an insulator between the cover 6 and a loop 10 comprised in the device 1, which loop is embedded in the dielectric part 9 at a first end part 11 (see FIG. 3) with a first end 12 (see FIG. 5) and a second end part 13, without covering a second end 14 (see FIG. 3). For the introduction of microwaves into or removal of microwaves from the cavity 3, a conductor 15 is connected to the second end of the loop 10. The connection between the loop 10 and the conductor 15 can, for example, be carried out by soldering or a press fit, where the end of the conductor 15 comprises fingers that can open outwards radially. This is not shown, however, as the actual connection does not constitute a part of the invention. An expert within the field can design the connection in a suitable way. A second and a third part, 16 and 17 respectively, of the dielectric part 9 are inserted in a first and second opening, 18 and 19 respectively, in the casing 2. The first opening 18 is designed to receive the second part 16 and the second opening 19 is designed to receive the third pan 17. As shown in FIG. 1, the first and the second opening are together smaller than the elongated hole 7 In the cover. As the first part 8 essentially corresponds to the hole 7 in the cover 6, the first part 8 cannot be inserted in the casing 2, but serves as a stop element when the device 1 is inserted into the casing 2 from outside. A first and second flange, 20 and 21 respectively, integral with the casing 2, are situated inside the casing 2 at least partially around the periphery of the first and second openings 18, 19, respectively, in order to give the device 1 a larger contact surface with the casing 2 and thereby achieve reliable stability between the device 1 and the casing 2. The second flange 21, which is designed for the third part 17, is provided with a recess or a hole 22 passing through the second flange 21, for receiving a locking device 23 (see FIGS. 3, 4). The through-hole 22 and the locking device 23 are located at such a distance from the outer aperture of the second opening 19 that the looking device 23 enters completely into the through-hole 22 scenically at the same time as the first part 8 of the dielectric part 9 comes into contact with an outer surface 24 of the casing 2 when the device 1 inserted into the casing 2. In this way, a locking effect is created between the device 1 and the casing 2, and it is not thereafter possible to move the device 1 relative to the casing 2.

Figure 2:
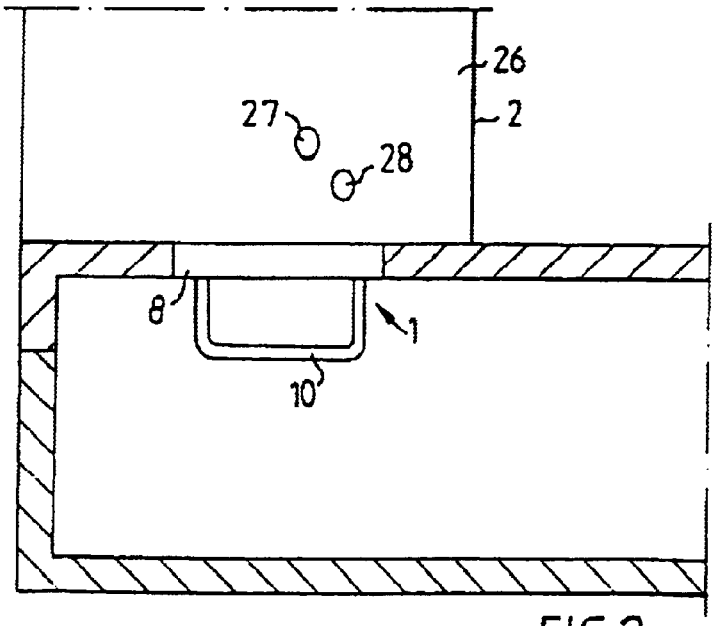
FIG. 2 shows a schematic side view of a part of a casing for electrical and/or electronic components and a part of a cavity housing.

The casing consists of two casing elements, of which a first casing element 25 is shown in FIG. 1, while a second casing element 26 (see FIG. 2) acts as a closing cover for the first casing element 25. FIG. 2 shows almost the same view as FIG. 1, but in FIG. 2 the second casing element 26 has been fitted on to show a first threaded hole 27 and a second threaded hole 28. In order to fix the device 1 more securely, the third part 17 is provided with a fixing hole 29 (see FIGS. 3, 6) to receive a fixing element, such as a screw (not shown). When the device 1 is secured in the casing 2 by the locking device 23 and the through-hole 22, the central axis of the fixing hole 29 is in line with the central axis of the first threaded hole 27, so that the fixing element can connect the second casing element 26 to the device 1. Of course, a threaded hole can be provided in the first casing element 25 instead of, or in combination with, the first threaded hole 27 in the second casing element 26. The second threaded hole 26 is designed to receive a means 30 in the form of a screw (see FIG. 3) for setting the capacitance between the loop 10 and earth, by the casing being earthed directly or indirectly, via the cavity housing 5 and the cover 6, in a conventional way.

Figure 3:
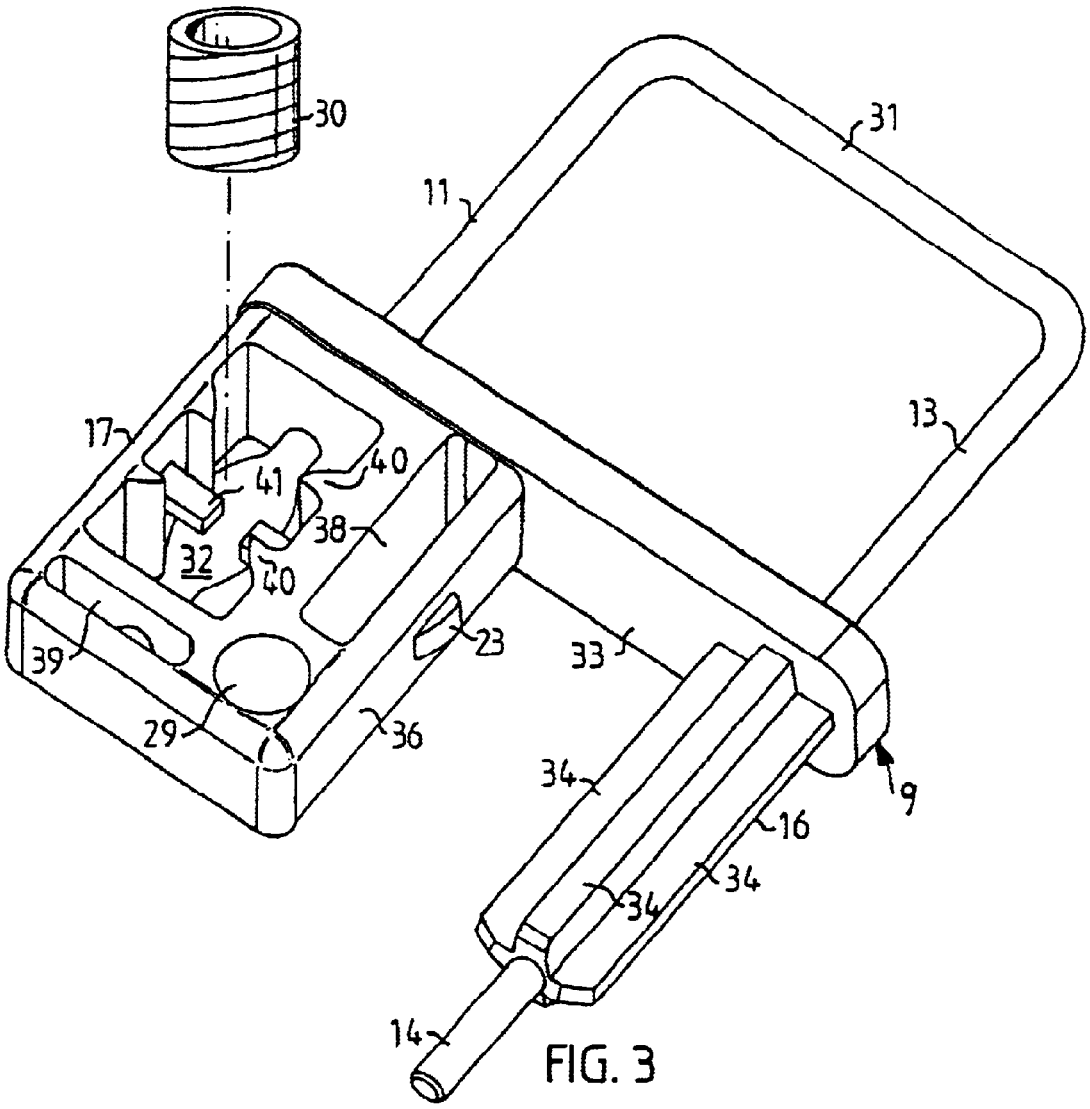
FIG. 3 shows a perspective view from obliquely above of a first embodiment of the device according to the invention.
Figure 4:
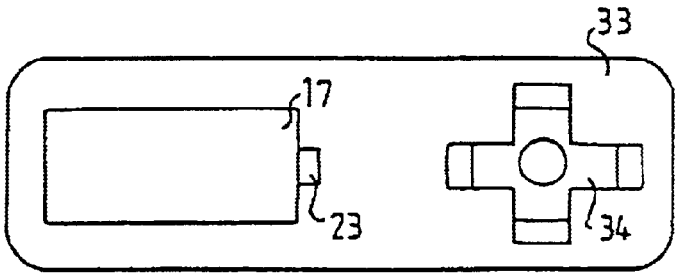
FIG. 4 shows a view of the device in FIG. 3 viewed from directly behind.

The design of the first embodiment of the device will now be described in greater detail with reference to FIGS. 3–5. In addition to the first and second end parts, 11 and 13 respectively, the loop 10 comprises a central part 31 (see FIG. 3), which is essentially at right angles in relation to the parallel end parts 11 and 13. The second end part 13 of the loop is designed together with the second part 16 to have a particular impedance to earth. The first end of the loop 12 (see FIG. 1), that is the one on the first end part 11, is housed in the third part 17 of the dielectric part 9. A stamped essentially flat section in relation to the rest of the loop, is housed in the third part 17 and constitutes a part of the first end part 11. This flat section has an essentially flat first area 32 that is designed for a particular frequency. The flat area 32 has a perpendicular that points essentially at right angles to the main plane of the loop 10, so that it is turned towards the means 30 for setting the capacitance between the loop 10 and earth. Both the first end part 11 and the second end part 13 are milled to give these parts a surface that ensures that the loop 10 is fixed in the dielectric part 9.

As the first part 8 of the dielectric part is used as a stop element, the first part 8 has an essentially flat contact surface 33 (see FIGS. 3,4) that is designed to make contact with the outer surface 24 of the casing so that further insertion of the device 1 into the casing 2 is prevented. The second part 16 of the dielectric part 9 extends essentially at right angles away from the contact surface 33. The second part 16 is designed as an elongated hollow rod with a cross-section that has an outer contour in the form of a cross, that is the cross-section comprises four radially-projecting projections 34 (see FIGS. 3, 4), with adjacent projections 34 being displaced essentially 90° in the direction of the circumference, as best seen in FIG. 4. Of course, the second part 16 can have a different cross-section, such as one with a circular, elliptical or polygonal outer contour, provided that the second part 16 together with the second end part 13 is designed for a predetermined impedance. The second part 16 has a free end 35 (see FIG. 5) on which the projection 34 is partially chamfered off in such a way that the cross-section of the second part 16 reduces gradually towards the free end 35. In this way, the insertion of the second part 16 into the first opening 18 in the casing 2 is made easier. The third part 17 (see FIGS. 3, 4) of the dielectric part 9 is integral with and extends essentially at right angles out from the contact surface 33. The third part 17 is cast as a right block comprising among other things: the locking device 23 on an essentially flat side 36 (see FIG. 3) which faces towards the second part 16; a relatively large first recess 37 (see FIG. 5) which is continuous; an elongated second recess 38 (see FIGS. 3, 5), which can be continuous and which extends essentially parallel with the first and second end parts of the loop 10; and an elongated third recess 39 (see FIGS. 3, 5), which can also be continuous and which extends essentially at right angles to the second recess 38. The first end part 11 of the loop 10 is embedded in the third part 17 in such a way that the first area 32 of the loop 10 is at least partially exposed in the first recess 37. The first recess 37 is preferably so large that there is relatively much dielectric in the form of air around the flat section. In order to provide reliable adjustable setting of the capacitance between the loop 10 and the casing 2 using the means 30, two opposing sections of the wall of the third part 17 that surrounds the first recess 37 are so designed that each of the sections defines two ribs 40 (see FIGS. 3, 5, 6) extending at least partially along the through direction of the first recess 37 and inwards towards the first end part 11 of the loop 10. These ribs 40 are preferably located symmetrically in relation to the flat section of the loop 10 and are sprung so that together they constitute a locking device for the means 30. In addition to the abovementioned fixing of the device 1 to the casing 2 by means of the fixing element and locking device, the ribs 40 make possible more accurate setting and fixing of the means 30 in relation to the loop 10. In the first recess 37 are also two stop pins 41 (see FIG. 3) arranged essentially extending towards each other. These stop pins 41 are located essentially midway between each pair of ribs viewed in the direction of the first end part 11 of the loop 10, and located in front of the flat area 32 viewed in the direction of insertion of the means 30 towards the flat area 32. The two stop pins 41 prevent the, means 30 from coming into contact with the loop 10. In addition, the stop pins 41 are designed to prevent galvanic contact between the means 30 and the loop 10, The locking device 23 is preferably an integral part of the third part 17. It consists of a sprung tongue with a sliding surface 42 (see FIGS. 5,6) which in the neutral position is angled in relation to the flat side 36 and a locking surface 43 (see FIG. 5) that is angled in relation to the sliding surface 42. When the device 1 is inserted into the casing 2, the locking device 23 is first compressed against the flat side 36, but when the looking device 23 is pushed over a first aperture of the through-hole 22, the locking device 23 springs out again so that the locking surface 43 prevents the device 1 from being pulled out of the casing 2. At the locking device 23, the flat side has a little slot that means that the locking device 23 is pressed into the slot upon insertion before it is pushed over the through-hole 22, so that the sliding surface 42 is essentially parallel to the flat side 36. In order to be able to pull the device out again without using interfering force, the locking device 23 is compressed against the flat side 36 by means of a tool (not shown) that can be inserted into the second aperture of the through-hole 22.

Even though it is not shown in connection with the first embodiment, the flat section has a flat second area, on the other side of the first area 32. As the first recess 37 is hollow, the means 30 can thus also be inserted towards the second area from an opposite direction with regard to the direction of insertion towards the first area. Stop pins can of course prevent the means 30 coming into contact with the second area. The recess can thus be symmetrical around its centre.

Figure 5:
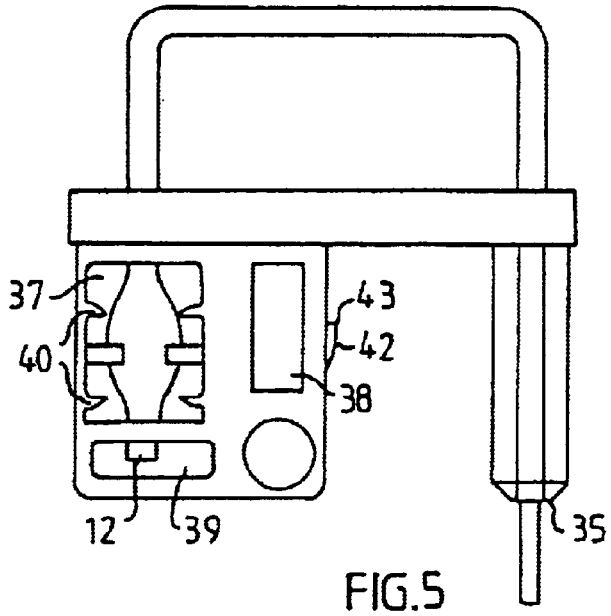
FIG. 5 shows a view of the device in FIG. 3 viewed from above.

As is best shown in FIG. 5, the first end 12 extends out into the third recess 39 to approximately half of the width of the third recess 39. The reason for this is to make easier the manufacture of the device 1, as during the embedding it is possible to hold and thereby determine the position of both ends 12, 14 of the loop 10 with appropriate tools.

Figure 6:
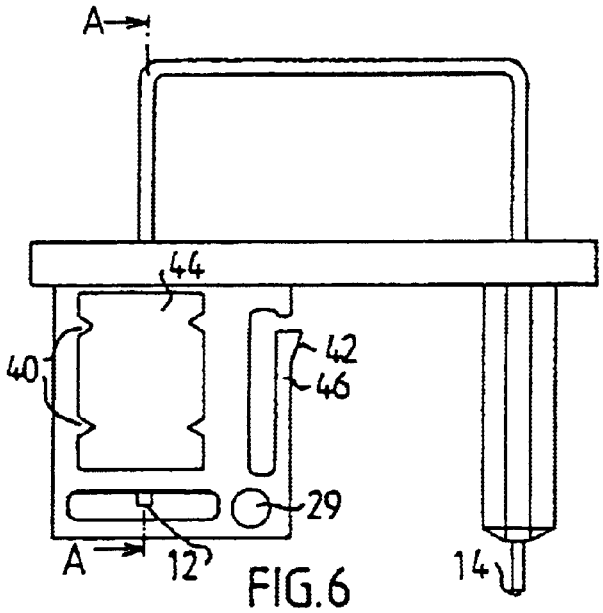
FIG. 6 shows a view from above of a second embodiment of the device.

FIG. 6 shows a second embodiment of the device 1. The dielectric part 9 is here provided with an essentially flat first surface 44 that constitutes a first bottom surface of the first recess 37. The first surface 44 has the same function as the stop pins 41 in the first embodiment, but the first surface 44 covers here the whole of the flat first area 32, which is thus not shown in FIG. 6. The second recess 38 (see FIG. 5) is here also open towards the flat side 36 of the third part 17, so that a slot 45 is created from the flat side 36 to the second recess 38. As the second recess here is parallel to the flat side 36, some of the material between the second recess 38 and the flat side 36 forms a cantilevered sprung tongue 46, where the locking device 23 is located on the free end of the tongue 46.

Figure 7:
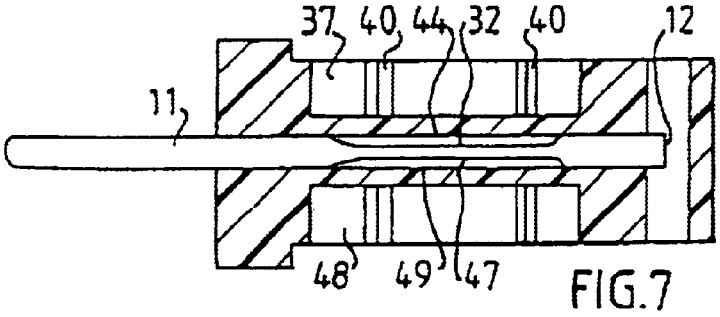
FIG. 7 shows a part of the section A—A in FIG. 6.

FIG. 7 shows that the second embodiment is provided with a flat second area 47 that is pointed essentially in the opposite direction with regard to the first area 32, and a recess 48 that is essentially reversed in relation to the first recess 37, which recess 48 has a bottom surface in the form of a second surface 49 that covers the second area 47. In this way, the first and the second areas, 44 and 49 respectively, cover the flat section of the loop 10 and prevent electrical flash-over between the flat section and the means 30. In this way, the same options are achieved for assembly as for the first embodiment.

Figure 8:
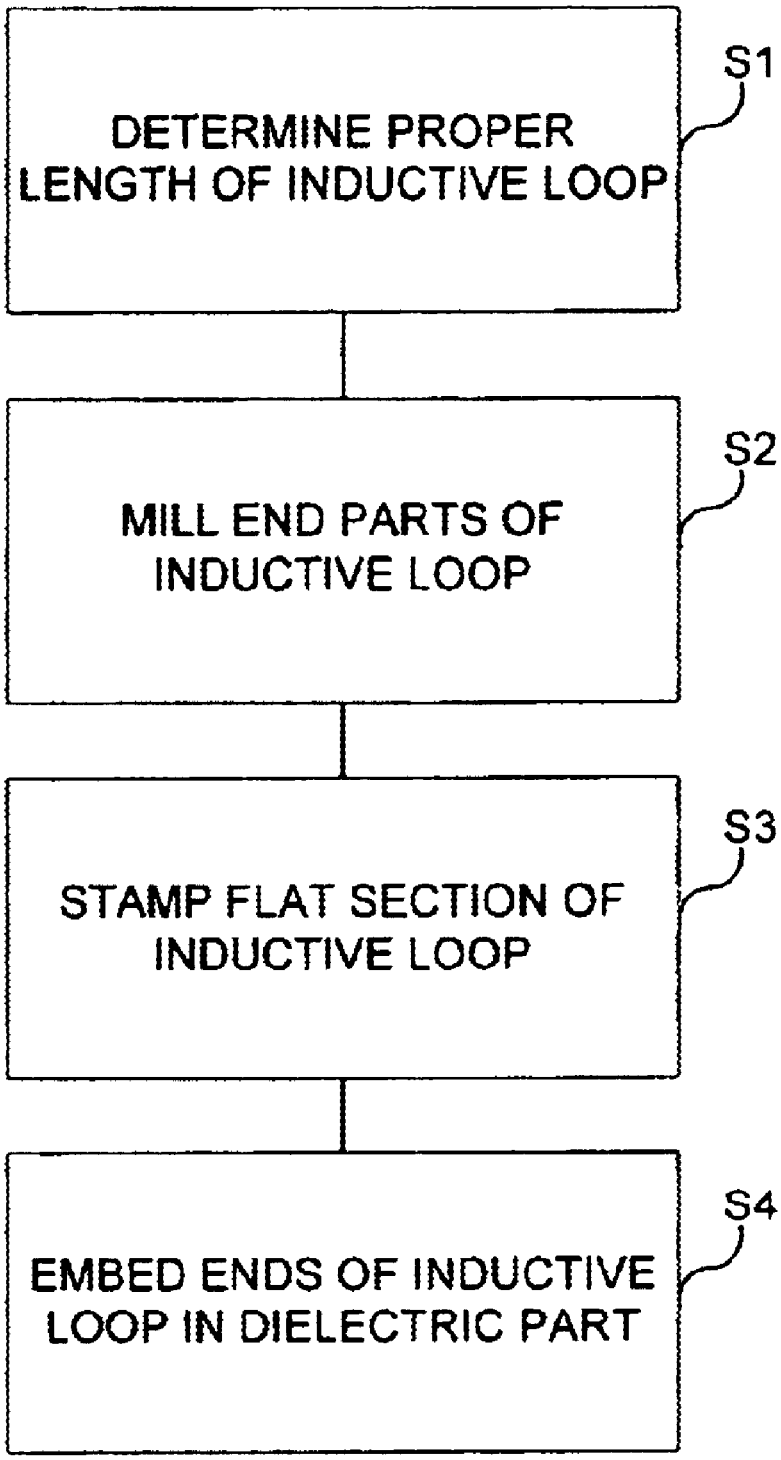
FIG. 8 shows a flow chart for a method according to the invention.

The manufacturing of the embodiments of the device 1 according to the invention will now be described with reference to FIG. 8. In step S1, the length is determined of the inductive loop 10. In step S2, the first and second end parts are milled so that the surface of the loop 10 is not smooth there. This makes easier the fixing of the loop 10 in the dielectric part 9 during the embedding that is carried out later. In step S3, the flat section is formed by the loop 10 being flattened by stamping. By this means, the frequency changing of the flat first area 32 and the flat second area 47 is achieved. In step S4, a part of the first end part 11 and the second end part 13 are embedded in the dielectric part 9.

Even though the loop in the preferred embodiment is essentially U-shaped with two bends, the concept of the invention of course comprises other shapes, such as a U-shape with only one bend or some other shape with more than two bends. Loops with bends that result in loop parts that principally extend in different planes are also possible.

It should also be pointed out that the dielectric part 9 can have other shapes than those shown in the embodiments. The dielectric part 9 could, for example, be formed as only a right block with diverse cavities for receiving fixing elements and means for adjusting the capacitance. Another possible embodiment of the dielectric part 9 is, for example, that the second part 16 shown in the preferred embodiment has a part that extends beyond the second end 14 of the loop 10 without being in contact with the second end 14, that is the part is designed to surround and screen the connection between the conductor 15 and the loop 10.

Even though it has not been shown here, the invention also of course comprises the possibility for the means 30 to be inserted in a recess at right angles to the perpendicular of, for example, the first area 32, that is the first area 32 can be transverse to the direction of insertion of the means 30.

In addition, it should be understood that, in addition to a screw, the means for setting the capacitance can be any other type of element, such as a metallic bolt or tube.

In addition, it should be understood that even though the device 1 is only directly fixed to the casing 2 by the locking device 23 and the fixing element in the preferred embodiment, the device can also, or instead, be fixed to a cavity housing and/or cover.

What is claimed is:

1. A device (1) for transmitting or receiving electromagnetic waves in a cavity (3), comprising a loop (10) and a dielectric part (9) that houses at least a first end part (11) of the loop (10), where the dielectric part (9) defines a first recess (37) arranged to receive a means (30) for setting the capacitance between the loop (10) and a grounded casing (2), cavity housing (5) or cover (6) and where the loop (10) is embedded in the dielectric part (9) at the first end part (11), and wherein the loop (10) comprises a flat section that is designed for a predetermined frequency.

2. A device (1) according to claim 1, where the dielectric part (9) comprises a locking device (23).

3. A device (1) according to claim 1, where the dielectric part (9) comprises a hole (29) designed to receive an element to securely fix the device (1) to the casing (2), cavity housing (5) or cover (6).

4. A device (1) according to claim 1, where the dielectric part (9) comprises at least one second recess (38).

5. A device (1) according to claim 1, where the dielectric part (9) comprises a bottom surface of the first recess, said bottom surface covers the flat section from a first direction, in order to prevent the means (30) for setting the capacitance from coming into galvanic contact with the loop (10) and to prevent electrical flash-over between the loop (10) and the means (30) for setting the capacitance.

6. A device (1) according to claim 5, where the dielectric part (9) comprises a second recess (48) on an opposite side of the dielectric part to the first recess (37), with a bottom surface that covers the flat section from an opposite direction to the first direction.

7. A device (1) according to claim 1, where the first end part (11) has an essentially straight longitudinal axis and the first recess (37) is turned essentially at right angles to the longitudinal axis.

8. A device (1) according to claim 1, comprising at least one stop pin (41) projecting into the first recess (37) in order to prevent the means (30) for setting the capacitance from coming into galvanic contact with the loop (10) and to prevent electrical flash-over between the loop (10) and the means (30) for setting the capacitance.

9. A device (1) according to claim 1, comprising at least one rib (40) inserted in the first recess (37) to make contact with the means (30) for setting the capacitance.

10. A device (1) according to claim 1, where the dielectric part (9) houses a second end part (13) of the loop (10).

11. A device (1) according to claim 10, where the dielectric part (9) is designed to provide a particular impedance to the grounded casing (2), cavity housing (5) or cover (6), together with the loop (10).

12. A device (1) according to claim 10, where the second end part (13) is substantially parallel to the first end part (11).

13. A device (1) according to claim 10, where at least one of the first end part (11) and the second end part (13) is milled in order to securely fixed, the loop (10) in the dielectric part (9).

* * * * *